US010529522B2

(12) United States Patent
Steinberger et al.

(10) Patent No.: US 10,529,522 B2
(45) Date of Patent: Jan. 7, 2020

(54) CIRCUIT BREAKER

(71) Applicant: Woehner GmbH & Co. KG Elektrotechnische Systeme, Roedental (DE)

(72) Inventors: Philipp Steinberger, Coburg (DE); Hubert Lenker, Sonneberg (DE)

(73) Assignee: WÖHNER GMBH & CO. KG ELEKTROTECHNISCHE SYSTEME, Rödental (DE)

( * ) Notice: Subject to any disclaimer, the term of this patent is extended or adjusted under 35 U.S.C. 154(b) by 103 days.

(21) Appl. No.: 15/578,672

(22) PCT Filed: Jun. 1, 2016

(86) PCT No.: PCT/EP2016/062331
§ 371 (c)(1),
(2) Date: Nov. 30, 2017

(87) PCT Pub. No.: WO2016/193283
PCT Pub. Date: Dec. 8, 2016

(65) Prior Publication Data

US 2018/0166245 A1 Jun. 14, 2018

(30) Foreign Application Priority Data

Jun. 1, 2015 (EP) ..... 15170118

(51) Int. Cl.
*H01H 75/00* (2006.01)
*H01H 77/10* (2006.01)
(Continued)

(52) U.S. Cl.
CPC ..... *H01H 77/107* (2013.01); *H01H 1/2066* (2013.01); *H01H 71/04* (2013.01);
(Continued)

(58) Field of Classification Search
CPC .... H01H 77/107; H01H 1/2066; H01H 71/04; H01H 71/58; H01H 71/70; H01H 71/665; H01H 71/048; H01H 79/00
(Continued)

(56) References Cited

U.S. PATENT DOCUMENTS 2,941,130 A * 6/1960 Krautwald ..... H01H 50/16 335/230
4,001,738 A * 1/1977 Terracol ..... H01H 77/108 335/16
(Continued)

FOREIGN PATENT DOCUMENTS

CN 103367065 A 10/2013
CN 204117960 U 1/2015
(Continued)

OTHER PUBLICATIONS

International Search Report and Written Opinion, and translation thereof, of International Application No. PCT/EP2016/062331, dated Sep. 6, 2016, 18 pp.
(Continued)

*Primary Examiner* — Shawki S Ismail
*Assistant Examiner* — Lisa N Homza
(74) *Attorney, Agent, or Firm* — Shumaker & Sieffert, P.A.

(57) ABSTRACT

A circuit breaker includes a current entry which conducts an electrical current via a wound coil conductor strip of a first coil to a first fixed contact, and includes a contact rocker which can be moved between two switching positions. The contact rocker includes mutually connected contact limbs. A first switching position of the contact rocker, electrically connects the first fixed contact with a second fixed contact which is connected via a wound coil conductor strip of a second coil to a current exit for dissipating an electrical
(Continued)

current flowing through the contact limbs of the contact rocker and the coil conductor strips of the coils to a current exit of the circuit breaker. A high electrical current which flows through the wound coil conductor strips of the coils and through the contact limbs of the contact rocker produces a magnetic field which generates a switching force which moves the contact rocker from the first switching position into a second switching position in which the two fixed contacts are electrically separated to interrupt the electrical current.

19 Claims, 2 Drawing Sheets

(51) Int. Cl.

| | |
|---|---|
| ***H01H 1/20*** | (2006.01) |
| ***H01H 71/04*** | (2006.01) |
| ***H01H 71/58*** | (2006.01) |
| ***H01H 71/70*** | (2006.01) |
| *H01H 73/04* | (2006.01) |
| *H01H 73/30* | (2006.01) |
| *H01H 71/66* | (2006.01) |

(52) U.S. Cl.
CPC ..... *H01H 71/58* (2013.01); *H01H 71/70* (2013.01); *H01H 73/04* (2013.01); *H01H 73/306* (2013.01); *H01H 2071/048* (2013.01); *H01H 2071/665* (2013.01)

(58) Field of Classification Search
USPC ..... 335/16
See application file for complete search history.

(56) References Cited

U.S. PATENT DOCUMENTS

| | | | | |
|---|---|---|---|---|
| 4,344,103 | A * | 8/1982 | Nagamoto | H01H 51/24 335/133 |
| 4,467,301 | A * | 8/1984 | Goodrich | H01H 1/54 335/195 |
| 7,283,339 | B2 * | 10/2007 | Tekletsadik | H01L 39/20 335/216 |
| 7,902,948 | B2 * | 3/2011 | Luders | H01H 9/346 218/146 |
| 8,451,076 | B2 | 5/2013 | Wendel et al. | |
| 8,698,582 | B2 * | 4/2014 | Uchida | H01H 1/54 335/131 |
| 9,053,885 | B2 * | 6/2015 | Gassmann | H01H 1/26 |
| 9,269,513 | B2 * | 2/2016 | Aarskog | H01H 33/10 |
| 9,691,562 | B2 * | 6/2017 | Neuhaus | H01H 1/54 |
| 2015/0244123 | A1 * | 8/2015 | Steinberger | H02B 1/21 439/119 |

FOREIGN PATENT DOCUMENTS

| | | | |
|---|---|---|---|
| DE | 8620645 | U1 | 1/1988 |
| DE | 19629867 | A1 | 2/1998 |
| DE | 10058419 | C1 | 6/2002 |
| DE | 202011106970 | U1 | 12/2011 |
| EP | 1850361 | A1 | 10/2007 |
| EP | 2429772 | A1 | 7/2012 |

OTHER PUBLICATIONS

International Preliminary Report on Patentability, and translation thereof, from International Application No. PCT/EP2016/062331, dated Dec. 5, 2017, 12 pp.
Extended Search Report from counterpart European Application No. 15170118.2, dated Dec. 14, 2015, 4 pp.
Notice of Intent to Grant from counterpart European Application No. 15170118.2, dated May 8, 2017, 5 pp.

* cited by examiner

CIRCUIT BREAKER

FIELD OF THE INVENTION

The invention relates to a self-triggering circuit breaker for short-circuit currents.

BACKGROUND OF THE INVENTION

When a short-circuit connection occurs, a high electrical current, which can be multiple times higher than a normal operating current, flows. Short-circuits can be caused e.g. by insulation which has become damaged or by a switching fault in electrical systems. Such short-circuit currents can be detected by protective devices and the conductors carrying the current can be switched off by power switches or fuses. Short-circuits can have different causes. Often, short-circuits are caused by a break in insulation or by changes to the insulation. Defective circuits in electrical switching systems and devices and the non-observance of safety rules can also result in short-circuits. If a short-circuit current is not correctly limited, damage can occur by over-heating in the wires or of electrical switching system components. In order to prevent the consequences of electrical short-circuits, safety switches and safety fuses can be used e.g. in low-voltage networks. Depending upon the application, the circuit breaker must be switched sufficiently quickly.

Accordingly there is a need to provide a circuit breaker which interrupts, in a quick and reliable manner, an occurring high electrical current.

SUMMARY OF THE INVENTION

Accordingly, in a first aspect the invention provides a circuit breaker comprising a current entry which conducts an electrical current via a wound coil conductor strip of a first coil to a first fixed contact, and comprising a contact rocker which can be moved between two switching positions and comprises mutually connected contact limbs which, in a first switching position of the contact rocker, electrically connect the first fixed contact with a second fixed contact which is connected via a wound coil conductor strip of a second coil to a current exit for dissipating an electrical current—flowing through the contact limbs of the contact rocker and the coil conductor strips of the coils—to a current exit of the circuit breaker, wherein a high electrical current, in particular a short-circuit current, which flows through the wound coil conductor strips of the coils and through the contact limbs of the contact rocker produces a magnetic field which immediately generates a switching force which moves the contact rocker at a high switching speed from the first switching position into a second switching position in which the two fixed contacts are electrically separated and the electrical current is interrupted.

The circuit breaker in accordance with the invention is self-triggering. The circuit breaker in accordance with the invention is particularly resistant to external influences. Furthermore, the circuit breaker in accordance with the invention has the advantage that it can be produced with relatively low outlay.

In one possible embodiment of the circuit breaker in accordance with the invention, the contact rocker is U-shaped and has contact limbs which are connected together via a connecting piece of the contact rocker.

In one possible embodiment of the circuit breaker in accordance with the invention, the wound coil conductor strips of the two coils each form an elongate winding cavity, in each of which a contact limb of the U-shaped contact rocker is arranged.

In a further possible embodiment of the circuit breaker in accordance with the invention, the first fixed contact is formed by an end, located in the winding cavity, of the wound coil strip of the first coil and the second fixed contact is formed by an end, located in the winding cavity, of the wound coil strip of the second coil.

In a further possible embodiment of the circuit breaker in accordance with the invention, the wound coil conductor strips of the coils are each wound 5 to 10 times around the winding cavity of the respective coil.

In a further possible embodiment of the circuit breaker in accordance with the invention, the wound coil conductor strips of the coils are each wound around the elongate cavity, wherein each winding has two mutually opposing elongate coil conductor strip sections which extend substantially in parallel with a contact limb of the contact rocker arranged in the winding cavity.

In a further possible embodiment of the circuit breaker in accordance with the invention, an electrical current which flows through the wound coil conductor strip of one of the coils and through the contact limb of the contact rocker arranged in the winding cavity of the respective coil produces, owing to the identical current flow direction, an attractive force between the contact limb and a first coil conductor strip section of the wound coil conductor strip of the coil and, owing to the opposite current flow direction, a repulsive force between the contact limb and a second coil conductor strip section of the wound coil conductor strip of the respective coil.

In a further possible embodiment of the circuit breaker in accordance with the invention, the wound coil conductor strips of a coil are electrically insulated from one another.

In a further possible embodiment of the circuit breaker in accordance with the invention, the switching duration during which the contact rocker is moved from the first switching position into the second switching position when a high current, in particular a short-circuit current, occurs is less than 0.1 ms.

In a further possible embodiment of the circuit breaker in accordance with the invention, the connecting piece of the contact rocker is mechanically mounted so as to provide stable end positions for the contact rocker in the two switching positions.

In a further possible embodiment of the circuit breaker in accordance with the invention, the cross-section of the coil conductor strips is designed for current intensities of more than 100 amps.

In a further possible embodiment of the circuit breaker in accordance with the invention, the width of the coil conductor strips of the coils is more than 1 cm.

The invention provides according to a second aspect a switching apparatus comprising a self-triggering circuit breaker in accordance with the first aspect of the invention, wherein a controllable semiconductor switch is interconnected in parallel with the circuit breaker to suppress an arc during opening of the circuit breaker.

In one possible embodiment of the switching apparatus in accordance with the invention, the controllable semiconductor switch is connected through when a high current, in particular a short-circuit current, occurs.

In a further possible embodiment of the switching device in accordance with the invention, the controllable semiconductor switch interconnected in parallel is blocked after a predetermined time.

In a further possible embodiment of the switching apparatus in accordance with the invention, it comprises an integrated control circuit for actuating the controllable semiconductor switch.

In a further possible embodiment of the switching apparatus in accordance with the invention, the control circuit integrated into the switching apparatus detects the occurrence of a high current, in particular a short-circuit current, by sensors.

In a further aspect, the invention provides a line safety switch having a circuit breaker in accordance with the first aspect of the invention.

BRIEF DESCRIPTION OF FIGURES

Possible embodiments of the circuit breaker in accordance with the invention and the switching apparatus in accordance with the invention will be explained in greater detail hereinafter with reference to the enclosed figures.

DETAILED DESCRIPTION OF EMBODIMENTS

Figure 1:
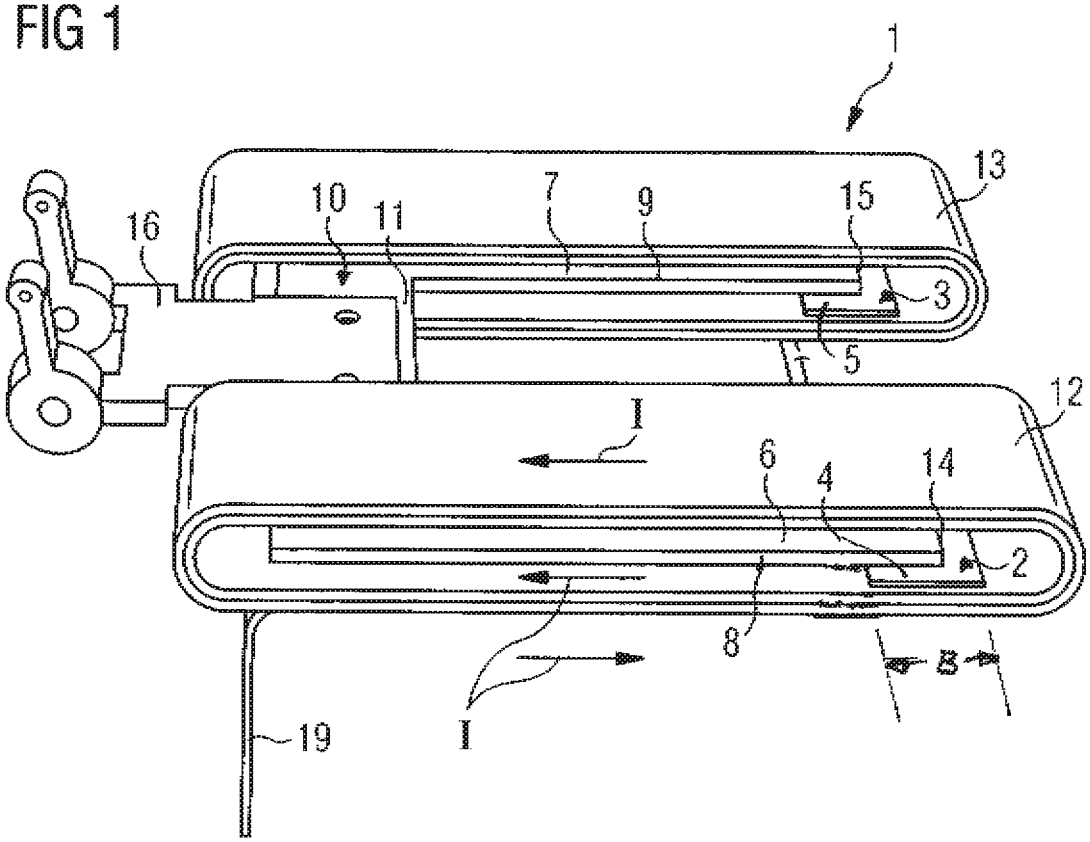
FIG. 1 shows a perspective view of one possible embodiment of the circuit breaker in accordance with the invention.

FIG. 1 shows a view of one possible exemplified embodiment of a circuit breaker 1 in accordance with the invention in a first aspect of the invention. A first fixed contact 2 and a second fixed contact 3 can be seen in FIG. 1. The two fixed contacts 2, 3 are formed in the illustrated exemplified embodiment by ends of coil conductor strips 4, 5. The coil conductor strips 4, 5 are each wound around a winding cavity 6, 7. A contact limb 8, 9 of a contact rocker 10 is located in each of the two winding cavities 6, 7, wherein the two contact limbs 8, 9 of the contact rocker 10 are connected together via a connecting piece 11, as shown in FIG. 1. In the illustrated exemplified embodiment, the contact rocker 10 is thus U-shaped and comprises two contact limbs 8, 9 which are located in the winding cavities 6, 7 of two coils 12, 13. The first coil 12 is formed by the first coil conductor strip 4 wound around the winding cavity 6. The second coil 13 is formed by the coil conductor strip 5 wound around the winding cavity 7. The coil conductor strips 4, 5 have a width B, as shown in FIG. 1. In one possible embodiment, the width B of the coil conductor strip 4, 5 is in a range of 1 to 2 cm, e.g. 1.5 to 1.6 cm. The coil conductor strips 4, 5 are wound around the associated winding cavity 6, 7 multiple times. In one possible embodiment, the wound coil conductor strips 4, 5 of the two coils 12, 13 are each wound 5 to 10 times around the associated winding cavity 6, 7 of the respective coil 12, 13.

The first fixed contact 2 which is formed by the end of the coil conductor strip 4 is electrically connected to a current entry of the circuit breaker 1 via the wound coil conductor strip 4. The second fixed contact 3 which is formed by the end of the second coil conductor strip 5 is connected to a current exit of the circuit breaker 1 via the wound coil conductor strip 5. The current entry conducts an electrical current I via the first wound coil conductor strip 4 of the first coil 12 to the first fixed contact 2. In normal operation, i.e. prior to the occurrence of a high electrical current or short-circuit current, the distal end 14 of the first contact limb 8 of the U-shaped contact rocker 10 lies against the first fixed contact 2. In an identical manner, in normal operation the distal end 15 of the second contact limb 9 of the U-shaped contact rocker 10 lies against the second fixed contact 3. Therefore, in this switching position the two fixed contacts 2, 3 are electrically connected together via the two contact limbs 8, 9 and the connecting piece 11 of the U-shaped contact rocker 10. The connecting piece 11 and the two contact limbs 8, 9 of the U-shaped contact rocker 10 consist of an electrically conductive material. The electrical current I flowing from the current entry to the first fixed contact 2 via the first coil conductor strip 4 flows via the contact limbs 8, 9 and the connecting piece 11 therebetween to the second fixed contact 3 and from there is discharged via the current exit of the circuit breaker 1. The circuit breaker 1 remains in this normal switching position so long as the electrical current I flowing therethrough does not exceed a certain current threshold value.

A high electrical current I, in particular a short-circuit current, which flows through the wound coil conductor strips 4, 5 of the two coils 12, 13 and through the two contact limbs 8, 9 of the contact rocker 10, produces a magnetic field B which immediately generates a switching force F which moves the contact rocker 10 at a high switching speed from the first switching position, in which the two fixed contacts 2, 3 are connected together via the contact rocker 10, into a second switching position in which the two fixed contacts 2, 3 are electrically separated and the electrical current I is interrupted. In one possible embodiment, the switching duration during which the contact rocker 10 is moved from the first switching position into the second switching position when a high current, in particular a short-circuit current, occurs is less than 0.1 ms.

In the embodiment illustrated in FIG. 1, the wound coil conductor strips 4, 5 of the two coils 12, 13 are each wound about the elongate winding cavity 6, 7, wherein each winding of two mutually opposing elongate coil conductor sections, namely an upper coil conductor strip section and a lower coil conductor strip section which extend substantially in parallel with the contact limb 8, 9 of the U-shaped contact rocker 10 arranged in the winding cavity. An electrical current I which flows through the wound coil conductor strip 4, 5 of one of the two coils 12, 13 and through the contact limb 8, 9 of the contact rocker 10 arranged in the winding cavity 6, 7 of the respective coil 12, 13 produces, owing to the identical current flow direction, an attractive force $F_1$ between the contact limb 8, 9 and a first coil conductor strip section of the respective wound coil conductor strip 4, 5 of the respective coil 12, 13 and, owing to the opposite current flow direction, a repulsive force $F_2$ between the contact limb 8, 9 and a second opposite coil conductor strip section of the respective wound coil conductor strip of the respective coil 12, 13. As can be seen in FIG. 1, the electrical current I flows, in the first normal switching position of the circuit breaker 1, from the first fixed contact 2 via the contact limb 8 in the direction towards the connecting piece 11 and thus in parallel with the electrical current which flows through the upper coil conductor strip section of the wound coil conductor strip 4 of the first coil 12. Owing to the formed magnetic field, the contact limb 8 is attracted upwards with an attractive force $F_1$ by the upper coil conductor strip section of the first coil 12. In an identical manner, FIG. 1 clearly shows that the current I flowing through the lower coil conductor strip section of the coil conductor strip 4 of the first coil 12 flows in an anti-parallel or opposite direction to the current I flowing via the first contact limb 8 and thus produces a repulsive force $F_2$ owing to the magnetic field.

The contact limb 8 is thus attracted by the current I flowing in parallel through the upper coil conductor strip section of the first coil 12 on the one hand and is simultaneously repelled by the lower coil conductor strip section of the first coil 12. The attractive force $F_1$ and the repulsive force $F_2$ thus have the same direction and, in the event of a sufficiently high electrical current or a current having a sufficiently high current amplitude, result in the contact limb 8 being moved, owing to the produced summed switching force $F(F=F_1+F_2)$, at an extremely high switching speed from the first switching position into a second switching position in which the contact limb 8 is separated from the first fixed contact 2 and thus the electrical current I is interrupted. The second contact limb 9 is opened in an identical manner owing to the currents flowing in a parallel or anti-parallel manner through the coil conductor strip sections of the second coil 13, i.e. the upper coil conductor strip section of the second coil conductor strip 5 of the second coil 13 exerts an attractive force $F_1$ on the contact limb 9, whereas the lower coil conductor strip section of the second coil conductor strip 5 of the second coil 13 produces a repulsive force $F_2$ on the contact limb 9 owing to the formed magnetic field.

As shown in FIG. 1, the connecting piece 11 of the U-shaped contact rocker 10 is preferably mechanically mounted so as to provide stable end positions for the contact rocker 10 in the two switching positions. A holder 16 is provided on the connecting piece 11 of the U-shaped contact rocker 10 and provides stable end positions for the U-shaped contact rocker 10 in the two switching positions by means of springs. In normal operation, the amplitude of the electrical current I flowing via the circuit breaker 1 is so low that the U-shaped contact rocker 10 is located in the lower stable end position and the two fixed contacts 2, 3 are electrically connected together. When a high electrical current or short-circuit current occurs, the U-shaped contact rocker 10 is moved into the other stable end position at a high switching speed by the produced magnetic field forces, the two fixed contacts 2, 3 being electrically separated from one another in said other stable end position. The number of windings of the two coil conductor strips 4, 5 of the two coils 12, 13 can be different for different current intensities depending upon the application. The more windings the two coils 12, 13 have, the greater the attractive or repulsive forces produced by the through-flowing current I, which forces act on the contact limbs 8, 9 of the contact rocker 10 so that the circuit breaker 1 triggers even at relatively low current intensities. Trip-free triggering of the circuit breaker 1 is effected when a short-circuit current occurs. "Trip-free triggering" is understood to mean the mechanism which prevents a system or a device from being switched on again whilst the cause of the disconnection still remains. The circuit breaker 1 in accordance with the invention, as illustrated in FIG. 1, is preferably symmetrical in design and comprises two coils 12, 13 which each surround a contact limb 8, 9 of the U-shaped contact rocker 10. In alternative embodiments, the contact rocker can also have a higher number of contact limbs which are each surrounded by an associated coil.

Figure 2:
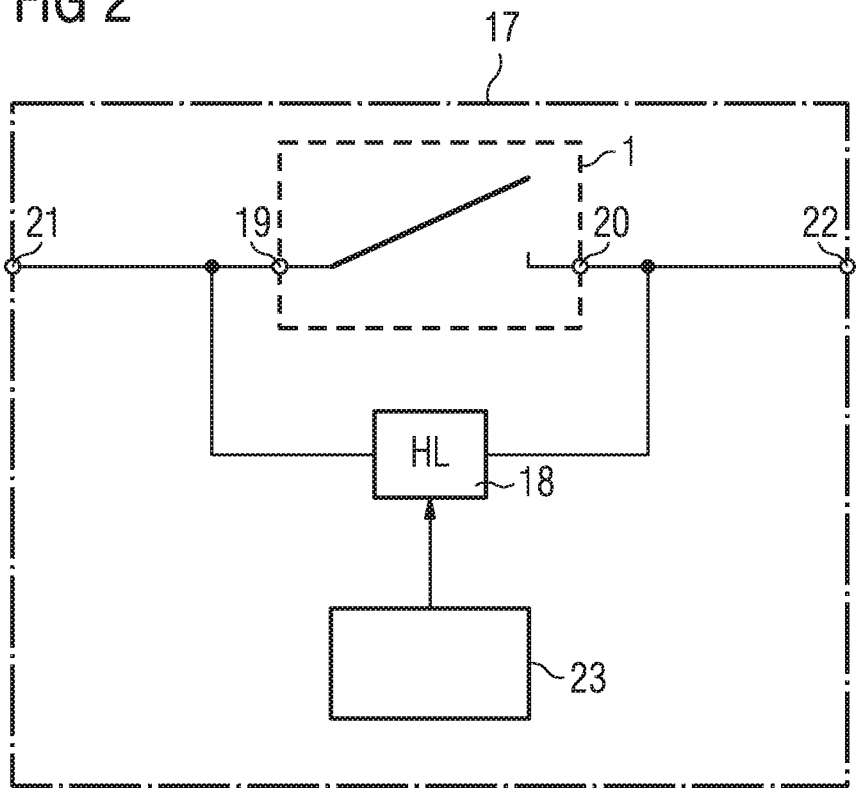
FIG. 2 shows a circuit diagram to illustrate one possible embodiment of the switching apparatus in accordance with the invention.

FIG. 2 shows a block diagram of one possible embodiment of a switching apparatus 17 in accordance with the invention which contains a self-triggering circuit breaker 1. The circuit breaker 1 is a self-triggering mechanical switch which switches at a high switching speed. In the switching apparatus 17 in accordance with the invention, a controllable semiconductor switch 18 is provided in parallel with the circuit breaker 1 to suppress an arc during opening of the circuit breaker 1. The controllable semiconductor switch 18 is e.g. a thyristor or the like. The current entry 19 of the circuit breaker 1 and the current exit 20 of the circuit breaker 1 are each connected to associated connections 21, 22 of the switching apparatus 17, as shown in FIG. 2. As shown in FIG. 2, the semiconductor switch 18, e.g. a thyristor, is interconnected in parallel with the circuit breaker 1. The controllable semiconductor switch 18 is connected through when a high current I, in particular a short-circuit current, occurs. The semiconductor switch 18 interconnected in parallel is blocked after a predetermined time. In the embodiment illustrated in FIG. 2, the switching apparatus 17 contains an integrated control circuit 23 which detects the occurrence of a high current, in particular a short-circuit current, by sensors.

Figure 3:
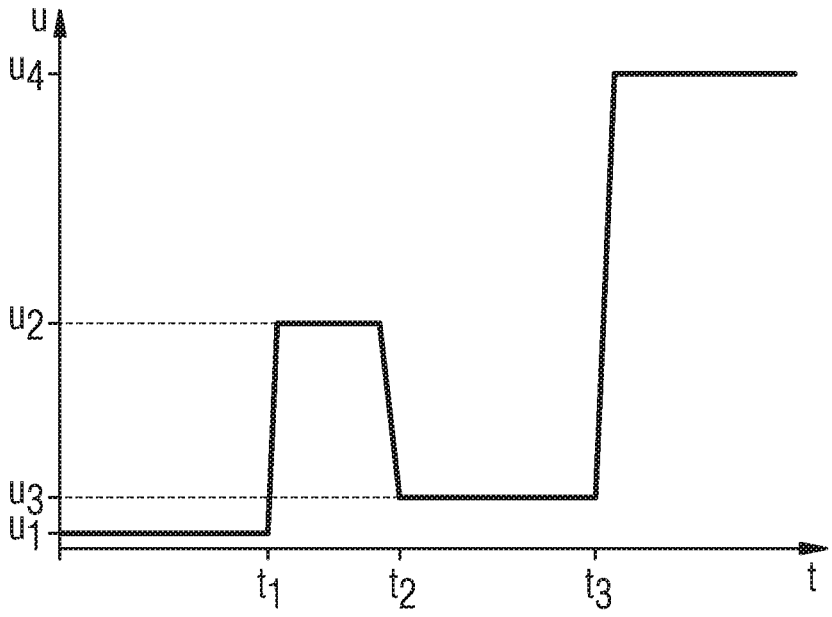
FIG. 3 shows a voltage progression over time for explaining the mode of operation of the switching apparatus illustrated in FIG. 2.

The mode of operation of the switching apparatus 17 illustrated in FIG. 2 having the circuit breaker 1 contained therein and the semiconductor switch 18 interconnected in parallel therewith will be explained in more detail with the aid of the voltage progression as per FIG. 3. Initially, in normal operation an electrical current I flows via the closed circuit breaker 1 from a current entry 21 directly to a current exit 22 of the switching apparatus 17. The switching apparatus 17 is symmetrical, i.e. the current entry 21 and current exit 22 can be swapped around. In normal operation, the current flows via the mechanical circuit breaker 1, wherein there is only a low voltage U1 at that location, as shown in FIG. 3. The voltage U1 can be e.g. 0.1 volts. At a time t1, a short-circuit current occurs which, owing to the produced magnetic field forces, moves the contact rocker 10 of the circuit breaker 1 into the other switching position with a high switching force, thus causing the circuit breaker 1 to open. The occurring forces act directly on the movable switching contacts or the contact limbs of the contact rocker 10. When the circuit breaker 1 is opening, the voltage 11 increases rapidly to a higher voltage value U2, e.g. 20 volts. The increase in voltage is detected by the control circuit 23 of the switching apparatus 17, wherein the control apparatus 23—from a certain threshold value—connects or connects through the semiconductor switch 18, which is connected in parallel, with a certain time delay at a time t2. The voltage 11 is hereby reduced to a lower voltage value U3, e.g. a voltage of 2 volts. Connecting through the semiconductor switch 18 suppresses the occurrence of an arc in the mechanical circuit breaker 1 and thus results in a clear protection of the circuit breaker 1 or in less deterioration. At a time t3, the controllable semiconductor switch 19 is switched off by the integrated control circuit 23 and the voltage increases to a high voltage value U4. At time t3, the semiconductor switch 18 and also the circuit breaker 1 are open or separated, and therefore current I can no longer flow between the current connections 21, 22 of the switching apparatus 17. The switching slope at time t1 is particularly steep owing to the particular design of the circuit breaker 1 illustrated in FIG. 1, i.e. the switching duration for mechanical switching is very short and is preferably less than 0.1 ms. The reaction time for connecting through the semiconductor switch 18 at time t2 is preferably likewise kept to a minimum in order to prevent the occurrence of an arc at the mechanical switch 1. In one possible embodiment, the self-triggering circuit breaker 1 acts when the ratio of the actually flowing current I, in particular short-circuit current $I_K$, to a normal current $I_{NORM}$ exceeds a certain ratio. In one possible embodiment, the self-triggering circuit breaker 1 acts when the ratio of the short-circuit current $I_K$ to the normal current $I_{NORM}$ is ≥20. This ratio can be different for different applications depending upon the particular geometry of the coils 12, 13 and the number of coil windings and the design of the switching or contact rocker 10.

The circuit breaker 1 in accordance with the invention and the switching apparatus 17 illustrated in FIG. 2 can be used for the widest variety of applications, e.g. electric vehicles, batteries and photovoltaic systems. In one possible embodiment, the cross-section of the coil conductor strips 4, 5 of the two coils 12, 13 is designed for current intensities of more than 100 amps. The wound coil conductor strips 4, 5 of the two coils 12, 13 are electrically insulated from one another. The currents I flowing through the coils 12, 13 produce magnetic forces F which immediately act on the moveable contact limbs 8, 9 of the contact rocker, and therefore the switching speed is extremely high and the switching duration is extremely short. The switching apparatus 17 in accordance with the invention contains a hybrid switching arrangement which consists of the mechanical circuit breaker 1 and the semiconductor switch 18. This hybrid circuit on the one hand switches particularly quickly and on the other hand is also particularly resistant to environmental influences. In addition, the hybrid circuit arrangement provided in the switching apparatus 17 has a particularly long service life and permits a high number of switching cycles or switching processes. The circuit breaker 1 in accordance with the invention can be produced with little outlay in a relatively simple manner. Depending upon the design of the coil conductor strips 4, 5 and the geometry of the two coils 12, 13, the circuit breaker 1 can also be designed for high current intensities of more than 100 amps, e.g. 400 or even 800 amps. The self-triggering circuit breaker 1 is characterised by an extremely high switching speed, wherein the semiconductor switch 18 prevents the occurrence of arcs. In normal, continuous operation, the circuit breaker 1 is closed. Since the circuit breaker 1 has an extremely low voltage level during normal, continuous operation, the loss in power when using the switching apparatus 17 in accordance with the invention in normal operation is extremely low. In the embodiment illustrated in FIG. 2, the control circuit 23 is integrated in the switching apparatus 17. In an alternative embodiment, the semiconductor switch 18 can also be actuated by an external control circuit of a device or a system.

The invention claimed is:

1. A circuit breaker comprising:

a current entry which conducts an electrical current via a wound coil conductor strip of a first coil to a first fixed contact, and comprising a contact rocker which can be moved between two switching positions, wherein the contact rocker comprises mutually connected contact limbs which, in a first switching position of the contact rocker, electrically connect the first fixed contact with a second fixed contact which is connected via a wound coil conductor strip of a second coil to a current exit for dissipating an electrical current flowing through the contact limbs of the contact rocker and the coil conductor strips of the coils to a current exit of the circuit breaker, wherein a high electrical current which flows through the wound coil conductor strips of the coils and through the contact limbs of the contact rocker produces a magnetic field which generates a switching force which moves the contact rocker from the first switching position into a second switching position in which the two fixed contacts are electrically separated and the electrical current is interrupted, and wherein the switching duration during which the contact rocker is moved from the first switching position into the second switching position when a high current occurs is less than 0.1 ms.

2. The circuit breaker as claimed in claim 1, wherein the contact rocker is U-shaped and has contact limbs which are connected together via a connecting piece of the contact rocker.

3. The circuit breaker as claimed in claim 2, wherein the wound coil conductor strips of the two coils each form an elongate winding cavity, in each of which a contact limb of the contact rocker is arranged.

4. The circuit breaker as claimed in claim 3, wherein the first fixed contact is formed by an end, located in the winding cavity, of the wound coil strip of the first coil, and wherein the second fixed contact is formed by an end, located in the winding cavity, of the wound coil strip of the second coil.

5. The circuit breaker as claimed in claim 4, wherein the wound coil conductor strips of the coils are each wound 5 to 10 times around the winding cavity of the respective coil.

6. The circuit breaker as claimed in claim 3, wherein the wound coil conductor strips of the coils are each wound around the elongate winding cavity, wherein each winding has two mutually opposing elongate coil conductor strip sections which extend substantially in parallel with a contact limb of the contact rocker arranged in the winding cavity.

7. The circuit breaker as claimed in claim 6, wherein an electrical current which flows through the wound coil conductor strip of one of the coils and through the contact limb of the contact rocker arranged in the winding cavity of the respective coil produces:

owing to the identical current flow direction, an attractive force between the contact limb and a first coil conductor strip section of the wound coil conductor strip of the coil, and owing to the opposite current flow direction, a repulsive force between the contact limb and a second coil conductor strip section of the wound coil conductor strip of the respective coil.

8. The circuit breaker as claimed in claim 1, wherein the wound coil conductor strips of a coil are electrically insulated from one another.

9. The circuit breaker as claimed in claim 2, wherein the connecting piece of the contact rocker is mechanically mounted to provide stable end positions for the contact rocker in the two switching positions.

10. The circuit breaker as claimed in claim 1, wherein a cross-section of the coil conductor strips is configured for current intensities of more than 100 amps.

11. The circuit breaker as claimed in claim 1, wherein the width of the coil conductor strips of the coils is more than 1 cm.

12. A switching apparatus comprising a self-triggering circuit breaker as claimed in claim 1, wherein a controllable semiconductor switch is interconnected in parallel with the circuit breaker to suppress an arc during opening of the circuit breaker.

13. The switching apparatus as claimed in claim 12, wherein the controllable semiconductor switch is connected through when a high current occurs.

14. The switching apparatus as claimed in claim 12, wherein the controllable semiconductor switch interconnected in parallel is blocked after a predetermined time.

15. The switching apparatus as claimed in claim 12, comprising an integrated control circuit for actuating the controllable semiconductor switch.

16. The switching apparatus as claimed in claim 15, wherein the control circuit integrated in the switching apparatus detects the occurrence of a high current by sensors.

17. A line safety switch having a circuit breaker as claimed in claim 1.

18. A circuit breaker, comprising:

a current entry which conducts an electrical current via a wound coil conductor strip of a first coil to a first fixed contact, and comprising a contact rocker which can be moved between two switching positions, wherein the contact rocker comprises mutually connected contact limbs which, in a first switching position of the contact rocker, electrically connect the first fixed contact with a second fixed contact which is connected via a wound coil conductor strip of a second coil to a current exit for dissipating an electrical current flowing through the contact limbs of the contact rocker and the coil conductor strips of the coils to a current exit of the circuit breaker, wherein a high electrical current which flows through the wound coil conductor strips of the coils and through the contact limbs of the contact rocker produces a magnetic field which generates a switching force which moves the contact rocker from the first switching position into a second switching position in which the two fixed contacts are electrically separated and the electrical current is interrupted, and wherein the wound coil conductor strips of the two coils each form an elongate winding cavity, in each of which a contact limb of the contact rocker is arranged.

19. A circuit breaker, comprising:

a current entry which conducts an electrical current via a wound coil conductor strip of a first coil to a first fixed contact, and comprising a contact rocker which can be moved between two switching positions, wherein the contact rocker comprises mutually connected contact limbs which, in a first switching position of the contact rocker, electrically connect the first fixed contact with a second fixed contact which is connected via a wound coil conductor strip of a second coil to a current exit for dissipating an electrical current flowing through the contact limbs of the contact rocker and the coil conductor strips of the coils to a current exit of the circuit breaker, wherein a high electrical current which flows through the wound coil conductor strips of the coils and through the contact limbs of the contact rocker produces a magnetic field which generates a switching force which moves the contact rocker from the first switching position into a second switching position in which the two fixed contacts are electrically separated and the electrical current is interrupted, and wherein a cross-section of the coil conductor strips is configured for current intensities of more than 100 amps.

* * * * *